US011035615B2

(12) United States Patent
Tan et al.

(10) Patent No.: US 11,035,615 B2
(45) Date of Patent: Jun. 15, 2021

(54) SUPPORT CLIP FOR FINNED TUBE TYPE HEAT EXCHANGERS

(71) Applicant: Caterpillar Inc., Deerfield, IL (US)

(72) Inventors: Dongming Tan, Dunlap, IL (US); Susan Jill Toher, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 176 days.

(21) Appl. No.: 16/110,042

(22) Filed: Aug. 23, 2018

(65) Prior Publication Data

US 2020/0064073 A1 Feb. 27, 2020

(51) Int. Cl.

| | |
|---|---|
| ***F28D 1/02*** | (2006.01) |
| ***F28F 1/30*** | (2006.01) |
| ***F28F 9/013*** | (2006.01) |
| ***F28D 1/053*** | (2006.01) |

(52) U.S. Cl.

CPC ..... *F28D 1/024* (2013.01); *F28D 1/05316* (2013.01); *F28F 1/30* (2013.01); *F28F 9/0138* (2013.01)

(58) Field of Classification Search

CPC . F28D 1/02; F28D 1/024; F28D 1/053; F28D 1/05316; F28F 1/02; F28F 1/126; F28F 1/30; F28F 1/32; F28F 9/013; F28F 9/0138; F28F 2275/14

USPC ..... 165/177, 178

See application file for complete search history.

(56) References Cited

U.S. PATENT DOCUMENTS

| | | | | |
|---|---|---|---|---|
| 2,862,693 A | | 12/1958 | Tinker | |
| 3,266,563 A | * | 8/1966 | Sinclair | F24D 19/00 165/82 |
| 3,934,645 A | * | 1/1976 | Butts | F28F 9/0138 165/67 |
| 4,030,540 A | * | 6/1977 | Roma | F28F 9/0132 165/172 |
| 4,095,648 A | * | 6/1978 | Shipes | F28F 9/0132 165/162 |
| 4,184,862 A | * | 1/1980 | Waters | F28D 15/0275 165/162 |
| 4,216,824 A | * | 8/1980 | Braun | F28F 9/0138 165/153 |
| 4,231,421 A | * | 11/1980 | Eaton | F28F 9/0132 165/125 |
| 4,356,795 A | * | 11/1982 | Loiez | F28F 9/013 122/511 |
| 4,570,704 A | * | 2/1986 | Braun | F28F 1/126 165/162 |
| 4,576,228 A | * | 3/1986 | Glatthorn | F28F 9/0131 165/162 |

(Continued)

FOREIGN PATENT DOCUMENTS

| | | |
|---|---|---|
| JP | 57175895 A | 10/1982 |
| JP | 61130796 A | 6/1986 |

(Continued)

*Primary Examiner* — Len Tran
*Assistant Examiner* — Gustavo A Hincapie Serna
(74) *Attorney, Agent, or Firm* — Hibshman Claim Construction PLLC

(57) ABSTRACT

A clip includes a body defining an exterior profile, and an adjustably sized aperture. The exterior profile defines at least one attachment feature and the body includes a surface defining the adjustably sized aperture and at least one stop member disposed in the adjustably sized aperture.

13 Claims, 3 Drawing Sheets

(56) References Cited

U.S. PATENT DOCUMENTS

| | | | | | |
|---|---|---|---|---|---|
| 5,086,831 | A * | 2/1992 | Paikert | B01D 53/8668 | 165/104.14 |
| 5,551,507 | A * | 9/1996 | Vogel | F28B 1/06 | 165/149 |
| 6,357,513 | B1 * | 3/2002 | Janezich | F28F 1/02 | 122/510 |
| 6,487,768 | B2 * | 12/2002 | Rhodes | B29C 65/58 | 29/564.8 |
| 2001/0040021 | A1 * | 11/2001 | Avequin | F28F 9/002 | 165/67 |
| 2012/0325443 | A1 * | 12/2012 | Miyata | F28F 1/36 | 165/162 |
| 2014/0284037 | A1 * | 9/2014 | Mokire | F28F 1/126 | 165/183 |
| 2016/0231066 | A1 * | 8/2016 | Gopireddy | F28F 21/067 | |
| 2016/0281976 | A1 | 9/2016 | Okimoto et al. | | |
| 2018/0266775 | A1 * | 9/2018 | Farlow | F28F 1/126 | |
| 2019/0017746 | A1 * | 1/2019 | Zheng | F28F 9/0132 | |

FOREIGN PATENT DOCUMENTS

| | | | | | |
|---|---|---|---|---|---|
| JP | 9196582 | A | | 7/1997 | |
| JP | 2002039502 | A | * | 2/2002 | F28F 1/36 |
| JP | 2002295989 | A | | 10/2002 | |

* cited by examiner

SUPPORT CLIP FOR FINNED TUBE TYPE HEAT EXCHANGERS

TECHNICAL FIELD

The present disclosure relates to support clips used to attach heat exchanges to the frame or chassis of a machine. Specifically, the present disclosure relates to a support clip used to hold onto a finned tube type heat exchanger and attach the heat exchanger to the frame or chassis of earth moving, construction, and mining machine and the like.

BACKGROUND

Machines, such as those used in the earth moving, construction, and mining industries use heat exchangers to cool engines or other heat producing devices. Support clips such as copper grommets are often employed to attach the tube of a heat exchanger, such as a radiator, to a frame or chassis of the machine. The interface between the clip and tube may experience play that may be caused by internal or external causes. Internal causes of this play may include erosion that occurs due to cavitation of the fluid flowing through the tube, leading to the tube wall deforming inwardly. External causes may include dimensional growth or contraction of the support clip due to changes in temperature or moisture, etc.

Play between the support clip and the tube may lead to further issues with wear and/or an improper orientation of the heat exchanger relative to the flow of air meant to draw heat from the tube. In time, a hole may also develop in the tube, resulting in an undesirable loss of cooling fluid from the tube.

U.S. Pat. No. 2,862,693 to Tinker discloses a support clip for finned tubes in a finned tube heat exchanger. The clamping mechanism provided by the support clip is adjustable for ease of assembly and disassembly. A filler is provided between the fins that contacts the tube outer diameter and that is configured to contact an aperture of a frame member. However, as shown in FIGS. 1 thru 5 of Tinker, the disclosed apparatus in Tinker requires that two frame members are provided with apertures such that one aperture of one frame member provides support to the finned tube on only one side while the other aperture of the other frame member contacts the opposite side of the finned tube.

Accordingly, Tinker does not adequately address the aforementioned problems since any movement of one frame member will result in either play between the clamping mechanism and the finned tube or a shearing action being placed on the finned tube. Also, Tinker does not account for the internal wear of the finned tube due to cavitation, etc.

SUMMARY

A heat exchanger according to an embodiment of the present disclosure may comprise a first tube member defining a perimeter and an axis of extension, and a first fin member including a first heat transfer portion extending from the perimeter of the first tube member along a direction that is not parallel to the axis of extension and a first straight portion disposed adjacent the tube member and extending along the tube member along the axis of extension.

A heat exchanger assembly according to an embodiment of the present disclosure may comprise a heat exchanger including a first tube member defining a perimeter and an axis of extension, and a first undulating fin section disposed adjacent the first tube member, a second undulating fin section disposed adjacent the first tube member and being spaced away axially from the first undulating fin section, defining an axial gap therebetween, and a clip disposed in the axial gap and at least partially encompassing the perimeter of the first tube member.

A clip for use with a tube member of a finned heat exchanger according to an embodiment of the present disclosure may comprise a body defining an exterior profile, and an adjustably sized aperture. The exterior profile defines at least one attachment feature and the body includes a surface defining the adjustably sized aperture and at least one stop member disposed in the adjustably sized aperture.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 2:
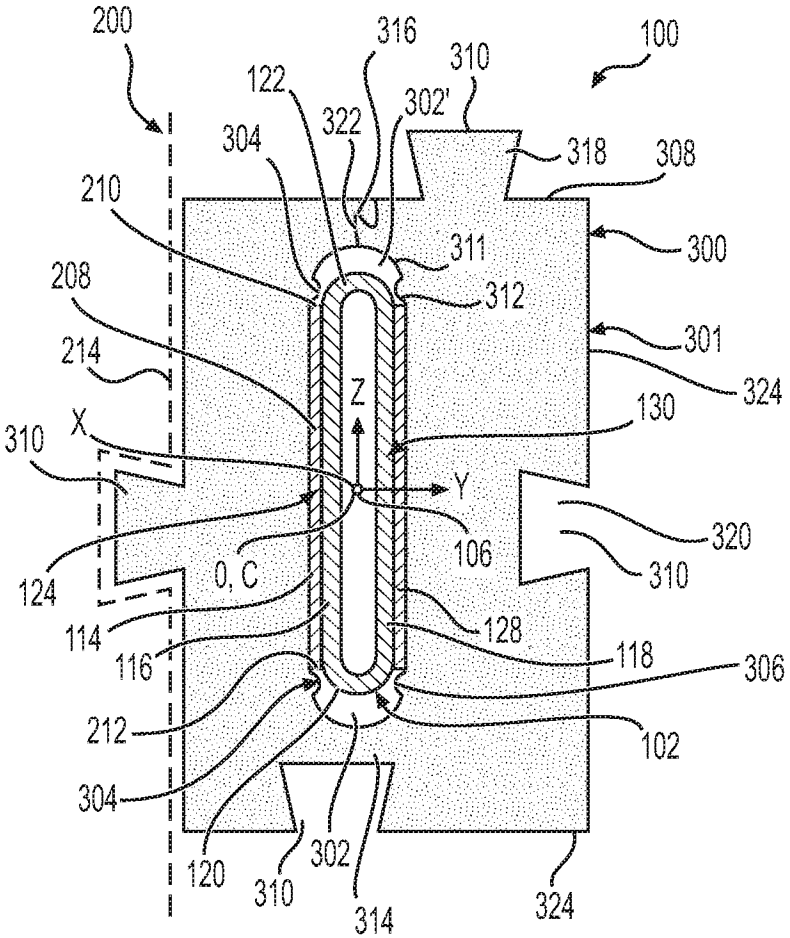
FIG. 2 is a sectional view of the finned tube and support clip of FIG. 1.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or by a prime for example, 100', 100" etc. It is to be understood that the use of letters or primes immediately after a reference number indicates that these features are similarly shaped and have similar function as is often the case when geometry is mirrored about a plane of symmetry. For ease of explanation in this specification, letters and primes will often not be included herein but may be shown in the drawings to indicate duplications of features, having similar or identical function or geometry, discussed within this written specification.

Various embodiments of an apparatus and a method for providing a heat exchanger, a heat exchanger assembly, a clip, and a method for assembly the same or attaching the same to a frame of a machine will now be described with reference to FIGS. 1 thru 3. In some embodiments, a heat exchange assembly that includes a clip that interfaces with the fins outside a radiator tube and that leaves a small portion of the fins straight without curving may be provided. Fins may be extended for clipping around the tube and a double wall may be brazed to the side of the tube. The double wall may provide more stiffness to the side of the tube and more material may provide a double margin for wear or cavitation erosion. Furthermore, four stops may be provided to help prevent the clip front contact the nose of the tube.

A heat exchanger according to an embodiment of the present disclosure will now be described with reference to FIGS. 1 and 2. The heat exchanger 100 may comprise a first tube member 102 defining a perimeter 104 and an axis of extension 106 and a first fin member 108. The first fin member 108 may include a first heat transfer portion 110 extending from the perimeter 106 of the first tube member 102 along a direction 112 that is not parallel to the axis of extension 106 and a first straight portion 114 disposed adjacent the tube member 102 and extending along the tube member 102 along the axis of extension 106. The first straight portion 114 may be attached to the perimeter 104 of the first tube member 102. More particularly, in some embodiments, the first straight portion 114 may be brazed to the first tube member 102.

Figure 3:
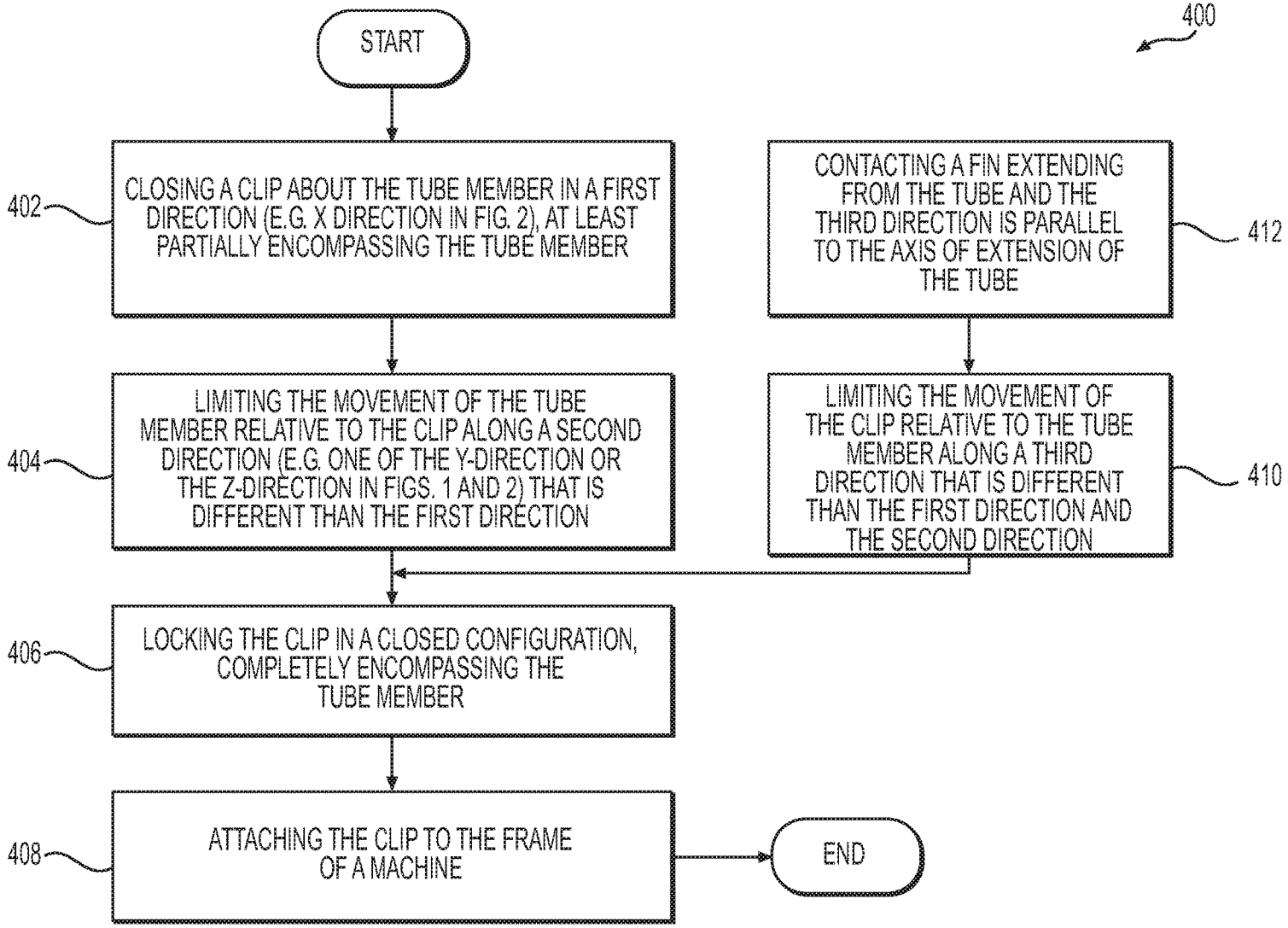
FIG. 3 is a flow chart depicting a method of using or assembling a heat exchanger assembly such as shown in FIGS. 1 and 2.

As best seen in FIG. 2, the first tube member 102 may include an annular configuration including a first straight side 116, a second straight side 118, a first arcuate portion 120 connecting the first straight side 116 to the second straight side 118, and a second arcuate portion 122 connecting the first straight side 116 to the second straight side 118. As shown in FIG. 2, the first straight side 116 may be parallel to the second straight side 118. Similarly, the first arcuate portion 120 may be disposed diametrically opposite of the second arcuate portion 122. Hence, the annular configuration may resemble an oval or a "race track" shape. The first straight portion 114 of the tube member 102 may contact the first straight side 116, forming a first double wall 124.

In various embodiments, the tube member 102 and the first fin member 108 comprise the same material. The same material may include one of the following: aluminum and copper. Other materials are possible such as those that are suitably durable and have enough thermal conductivity.

Referring again to FIGS. 1 and 2, the heat exchanger 100 may further comprise a second fin member 126 including a second heat transfer portion 127 extending from the perimeter 104 of the first tube member 102 along the direction 112 that is not parallel to the axis of extension 106. The second fin member 126 may also include a second straight portion 128 disposed adjacent the first tube member 102 and extending along the first tube member 102 along the axis of extension 106. The second straight portion 128 may be attached to the perimeter 104 of the first tube member 102, forming a second double wall 130.

The first tube member 102 may define a Cartesian coordinate system with an X axis, Y axis and Z axis, and an origin O placed at the center of mass C of the first tube member 102 with the X axis parallel to the axis of extension 106. Direction 126 may be parallel to the Y-axis in some embodiments.

In some embodiments, any fin member 108, 126 may have fins that spiral about the perimeter 104 of the first tube member 102 with an axis coincident with the axis of extension 106 in lieu of or in addition to the undulations. Also, only one fin member may be provided in other embodiments and the annular configuration of the first tube member 102 may have other shapes including rectangular, circular, etc. It is to be further understood that a plurality of tube members with fin members and cross-members that connect tube members together may be provided in various embodiments of the heat exchanger 100.

A heat exchanger assembly 200 will now be described with reference to FIGS. 1 and 2. The heat exchanger assembly 200 may comprise a heat exchanger 100 including a first tube member 102 defining a perimeter 104 and an axis of extension 106. The heat exchanger 100 may include a first undulating fin section 202 disposed adjacent the first tube member 102, a second undulating fin section 204 disposed adjacent the first tube member 102 and being spaced away axially from the first undulating fin section 202, defining an axial gap 206. The heat exchanger assembly 200 may further comprise a clip 300 disposed in the axial gap 206 and at least partially encompassing the perimeter 104 of the first tube member 102.

In some embodiments, the heat exchanger assembly 200 may further comprise a first straight section 208 connecting the first undulating fin section 202 to the second undulating fin section 204, but not necessarily so. The first straight section 208 may be attached to the perimeter 104 of the first tube member 102 and may extend axially along the perimeter 104 of the first tube member 102.

Figure 1:
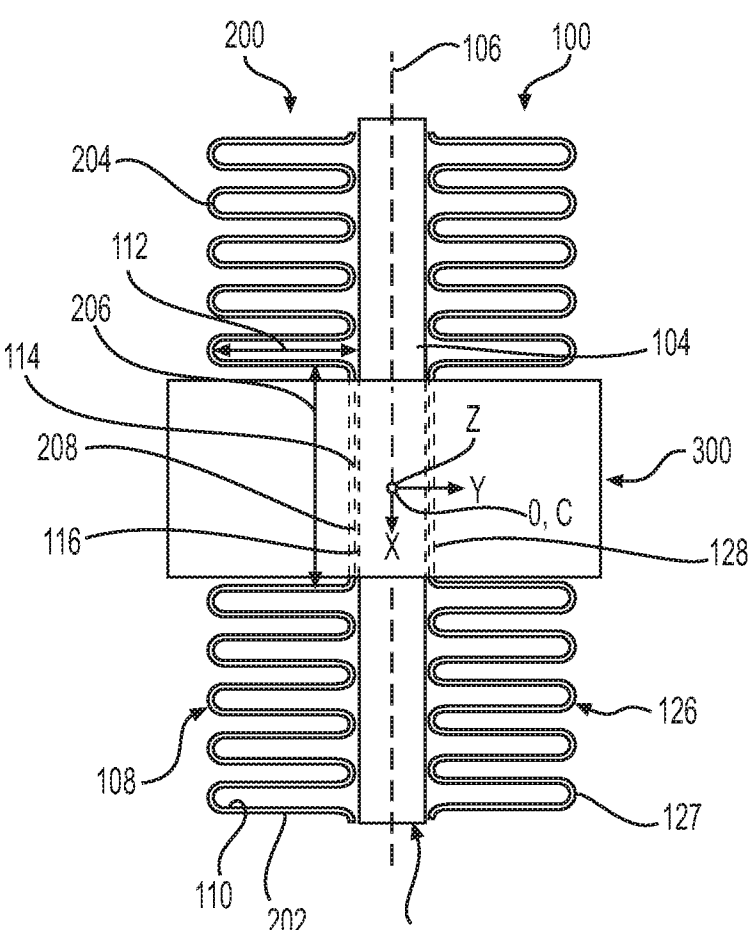
FIG. 1 is a front view of a heat exchanger assembly including a finned tube of a heat exchanger being supported by a support clip according to an embodiment of the present disclosure.

In some embodiments, such as shown in FIGS. 1 and 2, the clip 300 may at least partially encompass the first straight section 208. As best seen in FIG. 2, the clip 300 may define an aperture 302 and the first tube member 102 may extend axially through the aperture 302. In some embodiments, such as shown in FIG. 2, the clip 300 completely encompasses the perimeter 104 of the first tube member 102.

The first straight section 208 may define a first top edge 210 while the clip 300 may further include a first projection 304 disposed in the aperture 302 of the clip 300 adjacent the first top edge 210. Similarly, the first straight section 208 may define a first bottom edge 212 and the clip 300 may further include a second projection 306 disposed in the aperture 302 of the clip 300 adjacent the first bottom edge 212. Thus, the first and the second projections 304, 306 may prevent the nose (i.e. arcuate portions 120, 122) of the first tube member 102 from contacting the clip 200 along the Z axis. As shown in FIG. 2, the projections and the top and the bottom edges may be mirrored about the X-Z plane, providing redundancy.

Next, a clip 300 for use with a tube member 102 of a finned heat exchanger 100 will be described in detail with reference to FIG. 2. The clip 300 may comprise a body 301 defining an exterior profile 308, and an adjustably sized aperture 302'. The exterior profile 308 may define at least one attachment feature 310 and the body 301 may include a surface 311 defining the adjustably sized aperture 302' and at least one stop member 312 disposed in the adjustably sized aperture 302'.

In particular embodiments, the body 301 may define a living hinge 314 disposed adjacent the exterior profile 308 and forming a portion of the adjustably sized aperture 302' The body 301 may further define a seam 316 connecting the exterior profile 308 to the adjustably sized aperture 302'. The seam 316 may define an undercut 322 configured to keep the body 301 locked in a closed configuration to minimize the size of the adjustably sized aperture 302'. Once locked, the clip may hug or compress a tube member.

The at least one attachment feature 310 may take any suitable form including adhesive, fasteners, clips, threaded holes, etc. As shown in FIG. 2, the at least one attachment feature 310 may include at least one of the following: a tenon 318 and a mortise 320.

The exterior profile 308 may take any suitable shape. As shown in FIG. 2, the exterior profile 308 may include a quadrilateral shape with four sides 324. Any or each of the four sides 324 may include the at least one attachment feature 310.

The clip 300 may be made from any suitable material including plastic, metal, etc.

Figure 4:
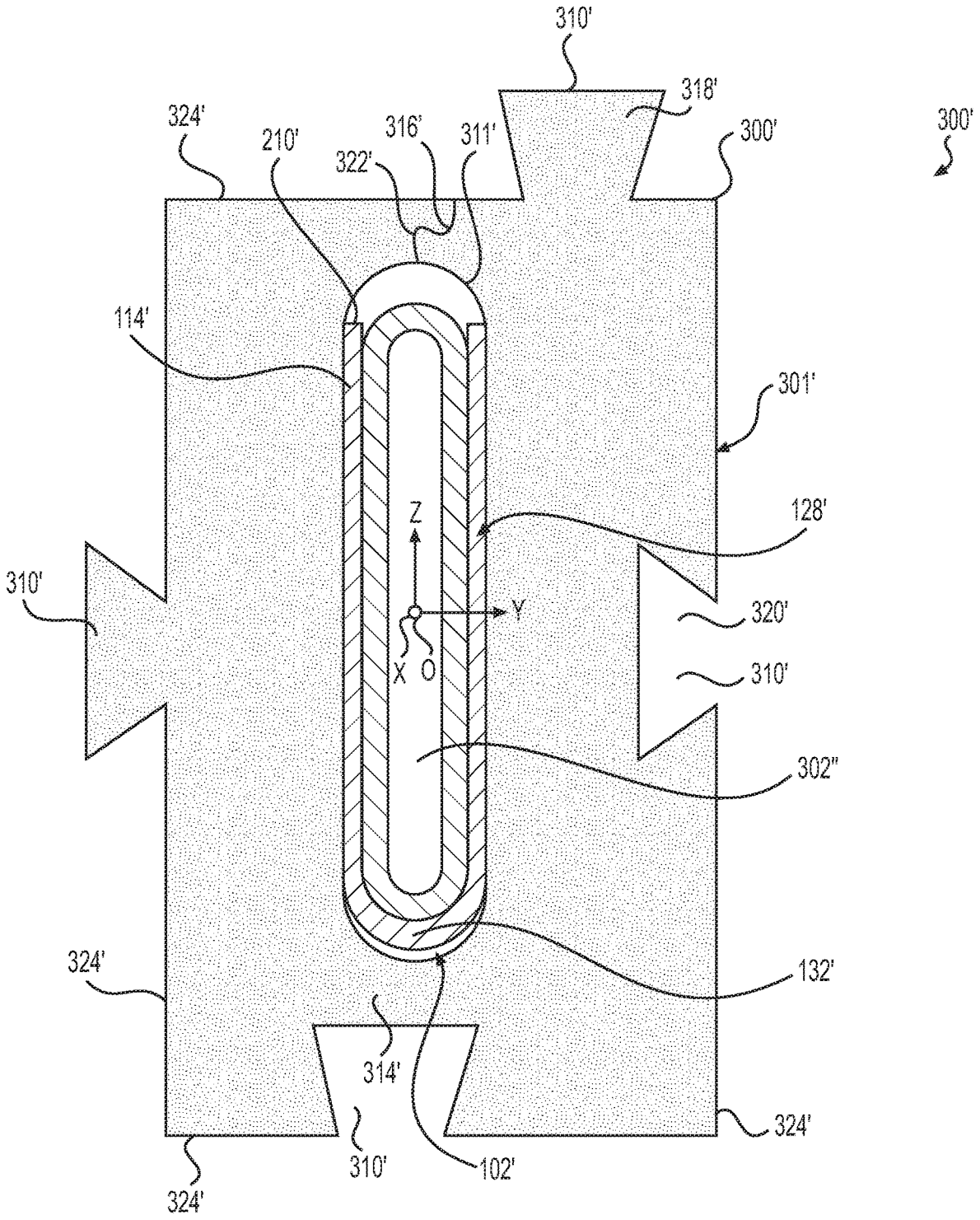
FIG. 4 is a sectional view of another embodiment similar to that of FIG. 2, except that a projection or a stop member for limiting the movement or placement of the tube member relative to the clip is omitted.

FIG. 4 illustrates another embodiment similar to that of FIG. 2 having the same features, except that a projection or a stop member for limiting the movement or placement of the tube member relative to the clip is omitted, etc.

As shown in FIG. 4, the clip 300' may define an aperture 302" and the first tube member 102' may extend axially through the aperture 302". In some embodiments, such as shown in FIG. 4, the clip 300' completely encompasses the perimeter 104' of the first tube member 102'.

The first straight portion 114' may define a first top edge 210'. The first straight portion 114' does not define a bottom edge and the clip 300' and does not include a projection disposed in the aperture 302' of the clip 300'. Instead, a bottom arch portion 132' connects the first straight portion 114' to the second straight portion 128'. Thus, the first tube member 102' and the bottom arch portion 132' are free to move down along the Z axis until contact with the wall (or surface 311') forming the aperture 302" near the living hinge 314'. As shown in FIG. 4, the first and second straight portions 114' and 128' and the bottom arch portion 132' may be symmetrical about the X-Z plane.

The clip 300' may comprise a body 301' defining an exterior profile 308', and an adjustably sized aperture 302". The exterior profile 308' may define at least one attachment feature 310' and the body 301' may include a surface 311' defining the adjustably sized aperture 302".

In particular embodiments, the body 301' may define a living hinge 314' disposed adjacent the exterior profile 308' and forming a portion of the adjustably sized aperture 302". This may not be the case in other embodiments. The body 301' may further define a seam 316' connecting the exterior profile 308' to the adjustably sized aperture 302". The seam 316' may define an undercut 322' configured to keep the body 301' locked in a closed configuration to minimize the size of the adjustably sized aperture 302". Once locked, the clip may hug or compress a tube member.

The at least one attachment feature 310' may take any suitable form including adhesive, fasteners, clips, threaded holes, etc. As shown in FIG. 4, the at least one attachment feature 310' may include at least one of the following: a tenon 318' and a mortise 320'.

The exterior profile 308' may take any suitable shape. As shown in FIG. 4, the exterior profile 308' may include a quadrilateral shape with four sides 324'. Any or each of the four sides 324' may include the at least one attachment feature 310'.

The clip 300' may be made from any suitable material as previously discussed.

Any of the dimensions, configurations, etc. discussed herein may be varied as needed or desired to be different than any value or characteristic specifically mentioned herein or shown in the drawings for any of the embodiments.

INDUSTRIAL APPLICABILITY

In practice, a heat exchanger, a heat exchanger assembly, a clip, and/or a machine using any embodiment disclosed herein may be sold, bought, manufactured or otherwise obtained in an OEM (original equipment manufacturer) or after-market context. In some cases, various components, of the heat exchanger, of the heat exchanger assembly, machine, etc. may be provided as a kit, etc.

A method 400 for attaching a tube member of a heat exchanger to the frame 214 (see FIG. 2) of a machine will now be described in reference to FIG. 3. The method 400 may comprise closing a clip about the tube member in a first direction (e.g. X direction in FIG. 2), at least partially encompassing the tube member (step 402), and limiting the movement of the tube member relative to the clip along a second direction (e.g. one of the Y-direction or the Z-direction in FIGS. 1 and 2) that is different than the first direction (step 404).

The method 400 may further comprise locking the clip in a closed configuration, completely encompassing the tube member (step 406).

The method 400 may further comprise attaching the clip to the frame of a machine (step 408).

The method 400 may further comprise limiting the movement of the clip relative to the tube member along a third direction that is different than the first direction and the second direction (step 410). In some embodiments, limiting the movement of the clip relative to the tube member along a third direction that is different than the first direction and the second direction includes contacting a fin extending from the tube and the third direction is parallel to the axis of extension of the tube (step 412).

With regard to FIG. 4, the method 400 may be substantially the same as explained with reference to FIG. 2, except that limiting movement in the Z-direction such that the tube member 102' is not accomplished via stop members or projections while in FIG. 2 stop members 312 or projections 304, 306 are used to keep the tube member 102 spaced away from the top end and/or bottom end of the aperture 302.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A heat exchanger assembly comprising:

a heat exchanger including a first tube member defining a perimeter and an axis of extension, an axial direction extending parallel to the axis of extension; and a fin comprising a first undulating fin section disposed adjacent to the first tube member, a second undulating fin section disposed adjacent to the first tube member and being spaced away from the first undulating fin section along the axial direction, defining an axial gap therebetween, and a first straight section connecting the first undulating fin section to the second undulating fin section; and a clip disposed in the axial gap and at least partially encompassing the perimeter of the first tube member, the clip defining an aperture and the first tube member extending axially through the aperture, such that the clip at least partially encompasses the first straight section, wherein the first straight section defines a first top edge and the clip further includes a first projection disposed in the aperture of the clip adjacent to the first top edge.

2. The heat exchanger assembly of claim 1 wherein the first straight section is attached to the perimeter of the first tube member and extends axially along the perimeter of the first tube member.

3. The heat exchanger assembly of claim 2 wherein the clip completely encompasses the perimeter of the first tube member.

4. The heat exchanger assembly of claim 1 wherein the first straight section defines a first bottom edge disposed opposite the first top edge and the clip further includes a second projection disposed in the aperture of the clip adjacent to the first bottom edge.

5. The heat exchanger assembly of claim 1 wherein the first straight section is brazed to the first tube member and the first tube member includes an annular configuration including a first straight side, a second straight side, a first arcuate portion connecting the first straight side to the second straight side, and a second arcuate portion connecting the first straight side to the second straight side.

6. The heat exchanger assembly of claim 5 wherein the first straight side is parallel to the second straight side, the first arcuate portion is disposed diametrically opposite of the second arcuate portion, and the first straight section contacts the first straight side, forming a first double wall.

7. The heat exchanger assembly of claim 1 wherein the first tube member and the fin comprise a same material.

8. The heat exchanger assembly of claim 7 wherein the same material includes one of the following: aluminum and copper.

9. The heat exchanger assembly of claim 1 wherein the clip comprises a body defining an exterior profile; and an adjustably-sized aperture, wherein the exterior profile defines at least one attachment feature, and the body includes a surface defining the adjustably-sized aperture and at least one stop member disposed in the adjustably-sized aperture.

10. The heat exchanger assembly of claim 9 wherein the body defines a living hinge disposed adjacent to the exterior profile and forming a portion of the adjustably-sized aperture, and a seam connecting the exterior profile to the adjustably-sized aperture.

11. The heat exchanger assembly of claim 9 wherein the at least one attachment feature includes at least one of the following: a tenon and a mortise.

12. The heat exchanger assembly of claim 9 wherein the seam defines an undercut configured to keep the body locked in a closed configuration to minimize the size of the adjustably-sized aperture.

13. The heat exchanger assembly of claim 9 wherein the exterior profile includes a quadrilateral shape with four sides, and each of the four sides includes the at least one attachment feature.

* * * * *